United States Patent [19]

Kilb et al.

[11] Patent Number: 5,000,597

[45] Date of Patent: Mar. 19, 1991

[54] DEVICE INCLUDING AN ELASTIC COVERING FOR TRANSPORTING RECORD SUBSTRATES IN OFFICE MACHINES, IN PARTICULAR FOR RECORDS IN RECORD PROCESSING APPARATUS

[75] Inventors: Hermann Kilb, Brigachtal; Egon Durler, Mönchweiler, both of Fed. Rep. of Germany

[73] Assignee: Mannesmann Aktiengesellschaft, Düsseldorf, Fed. Rep. of Germany

[21] Appl. No.: 357,522

[22] Filed: May 26, 1989

[30] Foreign Application Priority Data

May 26, 1988 [DE] Fed. Rep. of Germany ..... 3818167

[51] Int. Cl.[5] ..... B41J 13/00

[52] U.S. Cl. ..... 400/636; 400/247; 400/642

[58] Field of Search ..... 400/24, 25, 26, 247, 400/248, 320, 467, 618, 636, 642, 689, 690, 690.1, 690.2, 690.3, 690.4, 694

[56] References Cited

U.S. PATENT DOCUMENTS

| | | | |
|---|---|---|---|
| 1,499,709 | 7/1924 | Waldheim | 400/690.2 |
| 1,567,558 | 12/1925 | Waldheim | 400/690.3 |
| 3,034,782 | 5/1962 | Weidenhammer et al. | 400/636 X |
| 4,197,023 | 4/1980 | Deboo et al. | 400/642 X |
| 4,488,367 | 12/1984 | Yamauchi et al. | 400/636 X |
| 4,616,943 | 10/1986 | Matsumoto et al. | 400/247 |
| 4,684,273 | 8/1987 | Huffman et al. | 400/247 |

FOREIGN PATENT DOCUMENTS

| | | | |
|---|---|---|---|
| 0178342 | 4/1986 | European Pat. Off. | 400/248 |
| 0134768 | 8/1983 | Japan | 400/24 |

*Primary Examiner*—Edgar S. Burr
*Assistant Examiner*—Ren Yan
*Attorney, Agent, or Firm*—Horst M. Kasper

[57] ABSTRACT

A flat substrate (3) for surface structure is insertable, in each case, in positions where the processing means (5) are moved into positions outside of the path of the substrate, in particular for print and/or read means (6, 7) in a device for the transport of flat substrates (3) in office machines, in particular for records in record-processing apparatus (1). A pull-in shaft (8) or feed throat includes guide means which form, in transport direction (4), one or several successive, cross-running openings (19) for the processing means (5) movable cross to the transport direction (4). The openings (19) are closable, at least in part, by way of elastic coverings (24, 25) for achieving an interference-free pull-in of damaged and/or irregular substrates (3) or, respectively, records. The coverings (24, 25) form in transport direction (4), in each case, insert funnels (26) for the substrate (3) and, in case of cross motions of the processing means (5), the respective elastic covering (24, 25) is movable by the moved processing means (5) from the functioning position, assumed in the initial state during the moving by of the processing means (5), temporarily into another functioning position.

21 Claims, 4 Drawing Sheets

DEVICE INCLUDING AN ELASTIC COVERING FOR TRANSPORTING RECORD SUBSTRATES IN OFFICE MACHINES, IN PARTICULAR FOR RECORDS IN RECORD PROCESSING APPARATUS

BACKGROUND OF THE INVENTION

1. Field of the Invention

The invention relates to a device for the transport of flat substrates in office machines, in particular for records in record-processing apparatus, where the flat substrate for in each case, can be inserted into position, while the processing means, in particular print and/or read means, are moved into positions outside of the track path of the substrate and where a pull-in shaft or feed throat includes guide means, which form in transport direction one or several successively disposed crosswise running recess openings for the processing means, movable crosswise to the transport direction.

2. Brief Description of the Background of the Invention Including Prior Art

Such devices serve the purpose to insert record-carrier materials such as, for example, records, checks, forms, and the like, in a flat shape and without bulgings at the corners, into an office machine, for example, into a, record-processing apparatus or into a printer, and to bring them into a write or read position.

It is known to form a pull-in shaft or feed throat from one lower support plane at a lower part of an apparatus and from lower transport rollers, protruding through openings, and one counter roller, disposed respectively above the driven transport rollers, where a guide rail is additionally disposed opposite to the support plane, which guide rail limits the thickness of the thickest printing material and thus the height of the pull-in shaft or feed throat and which guide rail itself is not adjustable. In contrast, the upper counter roller is springingly adjustable and adjusts itself to the thickness of the flat substrate. Such substrates include paper, foils, bank books, flat carton, checks, forms, business forms, shipping papers, accounting sheets, and the like. The lower transport rollers are driven. The upper counter rollers can be driven and are, in most cases, of a smaller diameter than the lower transport rollers.

Special processing means are provided in such transport devices, which processing means can be moved crosswise to the transport direction of the substrate and which interrupt necessarily the course of the pull-in shaft or feed throat. For example, in a record-processing apparatus, the pull-in shaft or feed throat is interrupted in transport direction behind the first pair counter roller/transport roller by a crosswise running recess opening for a print head, where a print counter-support surface is disposed along the motion path track of the print head. A recess opening for a read head is provided in the same record-processing apparatus, disposed behind the motion path of the print head, as seen in the transport direction, and behind a further pair of counter roller/transport roller. This read head is also moved on a slider crosswise to the transport direction of the substrate. Opposite to the read head, only the above-recited support surface plane in the lower part of the apparatus is not interrupted within such a recess opening, which can occur in the lower part of the apparatus and/or in the upper part of the apparatus. However, the upper part of the apparatus, where the guide for the slider for the read head has to be disposed, has to be interrupted.

These recess openings of all kinds, as well as the processing means, including print head, print-head guide, read head, read-head guide, and the like, interfere in principle with the free transport of the substrate. In the case that the substrate now further exhibits deformations such as damages at the edges, dog's ears, and the like, then the transport of the substrate for surface structure is substantially endangered, if possible at all. In case of such interferences, there results an erroneous guiding of one or several substrates, for example, in case of small records, or a stoppage of deformed paper pieces, depending on the kind of processing.

SUMMARY OF THE INVENTION

1. Purposes of the Invention

It is an object of the present invention to avoid problems in office machines associated with interruptions in the transport path of the substrate in particular of a pull-in shaft or feed throat.

It is a further object of the present invention to provide means which will avoid interferences caused by recess openings in the path of records in office machines.

It is yet a further object to better and safer define the path of material guided through office machines.

These and other objects and advantages of the present invention will become evident from the description which follows.

2. BRIEF DESCRIPTION OF THE INVENTION

In accordance with the present invention, the recesses in the paper path of office machines are closed, at least in part, by elastic coverings, which in each case form feed-in funnels for the substrate in transport direction and that, in case of cross-motions of the processing means, the respective elastic covering is temporarily movable into a second functioning position by the moving processing means from its functioning position assumed in its initial state during the passing by of the processing means. Based on this, the coverings, for example made of transparent, thin plastic foils, can be created, which form initially insertion funnels for the substrate and after the pulling in of the substrate are opened in an interference-free pull-in operation into the pull-in shaft or feed throat and, after reaching of the recess opening, are opened for the processing means or are displaced by the processing means, i.e. are moved into a desired spatial position.

A lower bottom part of the office machine furnishes a lower part of a pull-in shaft or feed throat. A flat substrate can be inserted into the pull-in shaft or feed throat to run along a flat substrate track. Lower guide means are disposed in openings of the lower bottom part and form a lower part of the pull-in shaft or feed throat. An upper part of the office machine furnishes an upper part of a flat substrate track and an upper part of a pull-in shaft or feed throat. Upper guide means form an upper part of the pull-in shaft or feed throat and have an opening. An elastic covering is disposed in a first rest position over the opening, for closing the opening at least in part. The elastic covering forms, in its first rest position in transport direction, an insert funnel for the flat substrate. Processing means are positioned outside of the flat substrate track and movable into the area of the flat substrate track. The opening is elongated in a direction transverse to the transport direction for allowing the processing means to move crosswise to the transport direction for engagement with the flat substrate. The elastic covering is moved temporarily into a second operational position by the moving processing means from its operational rest position, assumed in an initial rest state while the processing means moves transverse to the flat substrate advance direction and the processing means passes over the flat substrate.

The flat substrate can be a record to be subjected to record-processing.

The processing means can be a printing means. A guide sheet metal piece can furnish the upper guide means. The covering can be attached at the guide sheet metal piece. The covering can run at an angle outside of the guide sheet metal piece. The covering can be coordinated to the printing means and the covering can cover an ink ribbon outside of a print field.

The processing means can be a reading means. A second covering can be disposed angled relative to a position of the first covering and disposed opposite to the first covering as seen from a middle line of the opening. The first covering and the second covering can be provided above the opening. The first covering and the second covering can be disposed relative to each other in positions from leaving a slot between each other to touching each other at a time when the reading means can be disposed in an end position.

The covering can be furnished with an additional angle section directed downwardly into the pull-in shaft or feed throat.

A second opening can be neighboring to the first opening. A second processing means can be disposed neighboring to the first processing means. A second covering can cover the second opening. The first covering associated with the first processing means and the second covering associated with the second processing means can be integrated into a single covering.

A method for transporting flat substrates in office machines can comprise the following steps. Processing means is positioned outside of a flat substrate track. A flat substrate is inserted into a pull-in shaft or feed throat forming an entrance port of a flat substrate track of an office machine including a lower bottom part of the office machine, lower guide means disposed in openings of the lower bottom part, an upper part of the office machine, and upper guide means having an opening. The flat substrate runs along a flat substrate track. The processing means, originally positioned outside of the flat substrate track, is moved into the area of the flat transverse track. The opening is elongated in a direction transverse, to the transport direction for allowing the processing means to move crosswise to the transport direction of the flat substrate for engagement with the flat substrate. An elastic covering is engaged with the moving processing means. The elastic covering is disposed in a first rest position over the opening, for closing the opening at least in part while the elastic covering is in a first rest position, thereby providing in transport direction an insert funnel for the flat substrate and thereby moving the elastic covering temporarily into a second operational position by the moving processing means from operational rest position of the elastic covering means assumed in an initial rest state, while the processing means moves transverse to the flat substrate advance direction, and while the processing means passes over the flat substrate.

A second covering can be engaged, disposed angled relative to a position of the first covering and disposed opposite to the first covering as seen from a middle line of the opening. The first covering and the second covering can be provided above the opening. The first covering and the second covering can be disposed relative to each other in positions from leaving a slot between each other to touching each other at a time when the reading means can be disposed in an end position.

A second processing means, disposed neighboring to the first processing means, is moved, and a second covering, associated with the second processing means is engaged.

According to an embodiment of the invention, the covering is attached to a guide sheet metal piece as a guiding means and runs outside of the guide sheet metal piece at an angle, where a covering, coordinated to a printing means, covers the ink ribbon outside of the print field. This covering for a print head, which can be lifted up or lowered, is thus successively used as an insertion funnel and as an ink-ribbon guide or, respectively, as an ink-ribbon covering, where deformed records are pulled in without interference and where a smearing of the record by the ink ribbon is prevented.

Another improvement of the invention provides that two oppositely disposed, angled coverings are provided above the recess opening for the read means, which coverings are disposed opposite to each other up to a slot or which touch each other. Thereby the foils in the course track region of the optical read device close up, when the read device is positioned in the right or left rest position, and thus form the desired insert funnel at the insertion side.

The invention is further illustrated in that the covering is provided with an additional angled-off section, directed downwardly into the pull-in shaft or feed throat. Thereby, the substrate, depending on the thickness of the substrate, is narrowed such that the substrate is guided, in case of a bulging at the top (head) or bottom (foot) side, narrower into the insertion shaft or feet throat and a misfeed of the substrate is prevented.

Finally, according to a further embodiment of the invention, the neighboring coverings for neighboring processing means can be integrated into a single covering. These features will limit the numbers of coverings or, respectively, foils.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
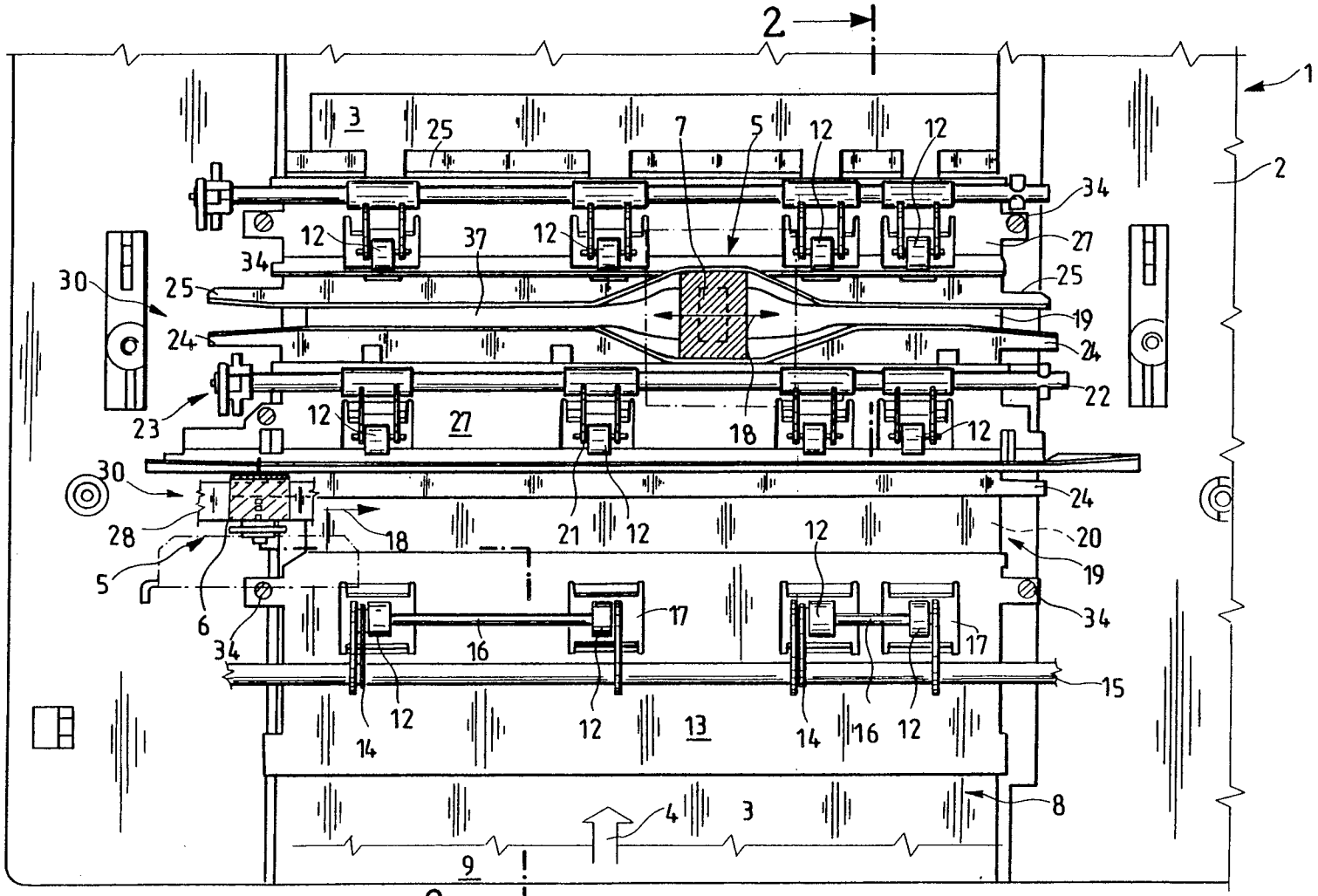
FIG. 1 is a plan view onto an opened record-processing apparatus with print and read means.

In accordance with the present invention, there is provided a device for the transport of substrates in office machines, in particular for records in record-processing apparatus. In each case, the flat substrate can be inserted, while, processing means, such as printing and/or reading means, are positioned outside of the flat substrate track. A pull-in shaft or feed throat includes guide means which form, in the transport direction, one or several successively disposed, cross-running openings for the processing means, movable crosswise to the transport direction. The openings 19 are closable at least in part by way of elastic coverings 24, 25. Said coverings 24, 25 form in transport direction 4, in each case, insert funnels 26 for the flat substrate 3 for surface structure. The respective elastic covering 24, 25 is moved temporarily into a second operational position by the moving processing means 5 from its operational rest position assumed in an initial state while the processing means 5 moves across to the flat substrate advance direction and during the passing by of the processing means 5.

The covering 24 can be attached to a guide sheet metal piece 27 as a guide means. The covering 24 can run at an angle 24*a* outside of the guide sheet metal piece 27. A covering 24, coordinated with a printing means 6, can cover the ink ribbon 28 outside of the print field 29.

Two coverings 24, 25, angled and disposed opposite to each other, can be provided above the opening 19 for the read means 7. Said coverings 24, 25 can be disposed opposite to each other, leaving an opening from a slot between each other to touching each other while the read means 7 are disposed in end positions 30.

The covering 24 can be furnished with an additional angle section 31, directed downwardly into the pull-in shaft or feed throat 8. The neighboring coverings for the neighboring processing means 5 can be integrated to a single covering 24.

A record-processing apparatus 1 with a lower bottom part 2 of the apparatus 1 is illustrated as an office machine in FIG. 1. A substrate 3 is moved in transport direction 4 through the record-processing apparatus 1. The substrate 3 can comprise records, such as generally employed in banking operations. Therefore, processing means 5 are required for the processing of the substrate 3, which processing means 5 comprises in the present case a print means 6, such as for example a matrix pin print head or a thermal print head, or a read means 7 for optical character recognition.

A pull-in shaft or feed throat 8 comprises a lower support plane 9 at the lower bottom part 2 of the apparatus 1 and lower transport rollers 11, protruding through openings 10, and a counter roller 12, disposed in each case above the corresponding transport roller 11. A guide plate 13 is disposed opposite to the support plane 9 at the start of the pull-in shaft or feed throat 8. The guide plate 13 limits the thickness of the thickest point material and thus the height of the pull-in shaft or feed throat 8. The guide plate 13 itself is not adjustable. In contrast, the counter roller 12 is springingly adjustable and adjusts to the thickness of the substrate 3. The lower transport roller 11 can be driven via driving means 110. According to the embodiment of FIG. 1, the counter roller 12 is driven by way of a belt drive 14 or by way of similarly acting drive elements only at the front pair of counter roller 12 and transport roller 11. A joint drive shaft 15 serves for transferring the drive power. In each case, two counter rollers 12 are supported jointly and are connected via shafts 16. The length of the shafts 16 is set to the width of a substrate 3 or, respectively, of a recording material. The guide plate 13 is furnished with openings 17 for the counter roller 12. The transport rollers 11 are all driven, only in case of the first roller pair on the right hand side of FIG. 3, the counter roller 12 is also driven.

The processing means 5 are movable in cross direction 18, i.e. crosswise to the transport direction 4 of the substrate 3. Special slider guides 107 are provided for the cross direction 18. These slider guides are however without importance for the understanding of the invention in its particular embodiment. The auxiliary means, necessary in each case, for the processing means 5, i.e. the slider guides for the processing means 5, interrupt necessarily the course of the pull-in shaft or feed throat 8. Thus, for example, in the illustrated record-processing apparatus 1, the pull-in shaft or feed throat 8 is interrupted in transport direction 4 behind the first pair of counter roller 12 and transport roller 11 by a crosswise running opening 19. A print substrate-surface support 20, disposed within the opening 19, has a length which corresponds to the path of motion of the print means 6. Additional transport rollers 11 and counter rollers 12 are now disposed in transport direction 4 behind the opening 19. In this case, the counter rollers 12 are, in each case, pivotally supported at tilting levers 21, and all tilting levers 21 are attached to a tilting shaft 22, which is furnished with a drive 23. In this case as well, an opening 19 follows to the pair of counter roller 12 and transport roller 11, which opening 19 is however represented by the said slider guide for the read means 7. Again in this case, the pull-in shaft or feed throat 8 is interrupted such that the danger of a paper stoppage occurs. The opening 19 is disposed in the region of the read means 7 in the upper part of the apparatus 1, not illustrated in detail.

The invention solves the problem of misfeed of substrate 3 by having the openings 19 closable at least in part with elastic coverings 24 or 25, where these elastic coverings 24 or, respectively, 25 are comprising, for example, transparent, elastic plastic foils, and where these elastic coverings 24, 25 form, in each case, their own insert funnels 26, in order to avoid a paper stoppage and misfeed based on an irregular substrate 3.

The system of the elastic coverings 24, 25 is further formed such that the cross motion of the processing means 5 changes the initial state and/or initial position of the coverings 24 or, respectively, 25 for the crossing over of the processing means 5, where the insertion funnel, 26 in each case, is lost temporarily or remains available. After the passing over is performed, i.e. the processing of the substrate 3, the initial state is taken up again.

The covering 24 is attached to a guide sheet metal piece 27 as a guide means and runs outside of the guide sheet metal piece 27 as an angle-shaped covering 24*a*. The covering 24, coordinated with the print means 6, covers an ink ribbon 28 outside of the print field 29, whereby smearing of the substrate 3 is avoided.

Two coverings 24 and 25, disposed opposite to each other, are present above the opening 19 for the read means 7. When the read means 7 is disposed in its end position 30, the coverings 24 and 25 are disposed opposite to each other up to a slot 37, or they even touch each other.

Figure 2:
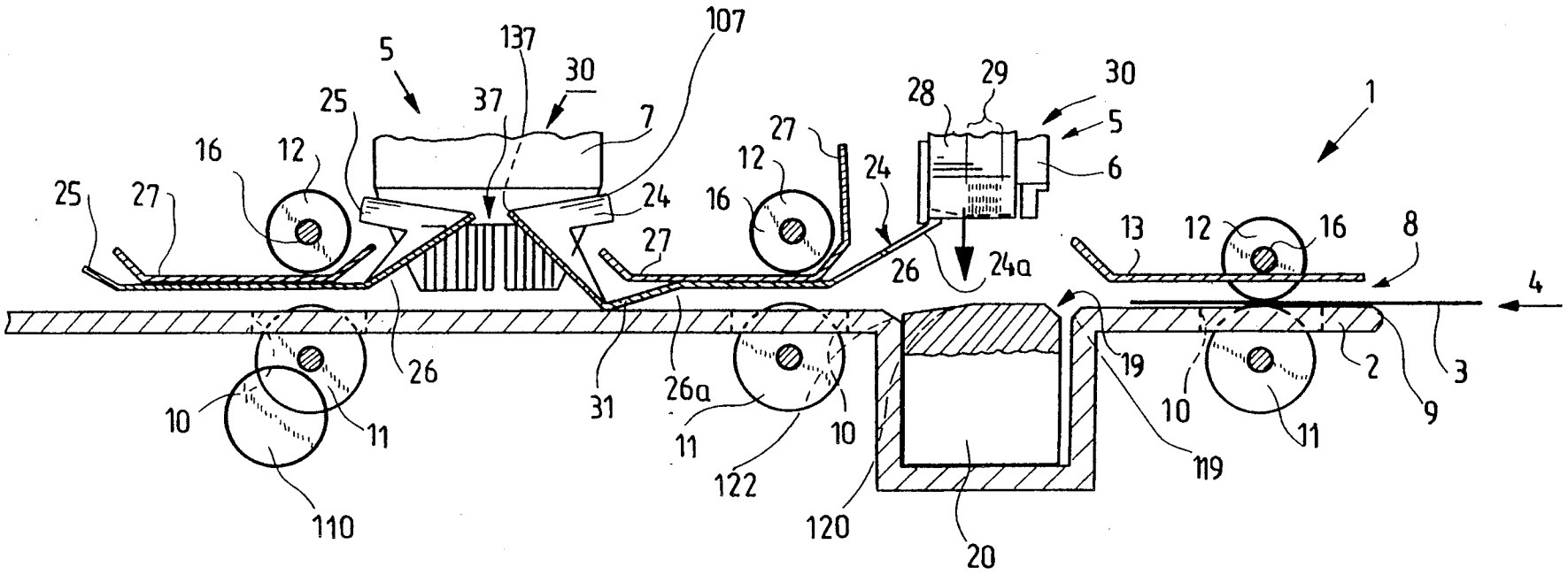
FIG. 2 is a cross-sectional view along section line 2—2 of the embodiment of FIG. 1, where the read means, however, is positioned in its end position, i.e. at a stop.
Figure 3:
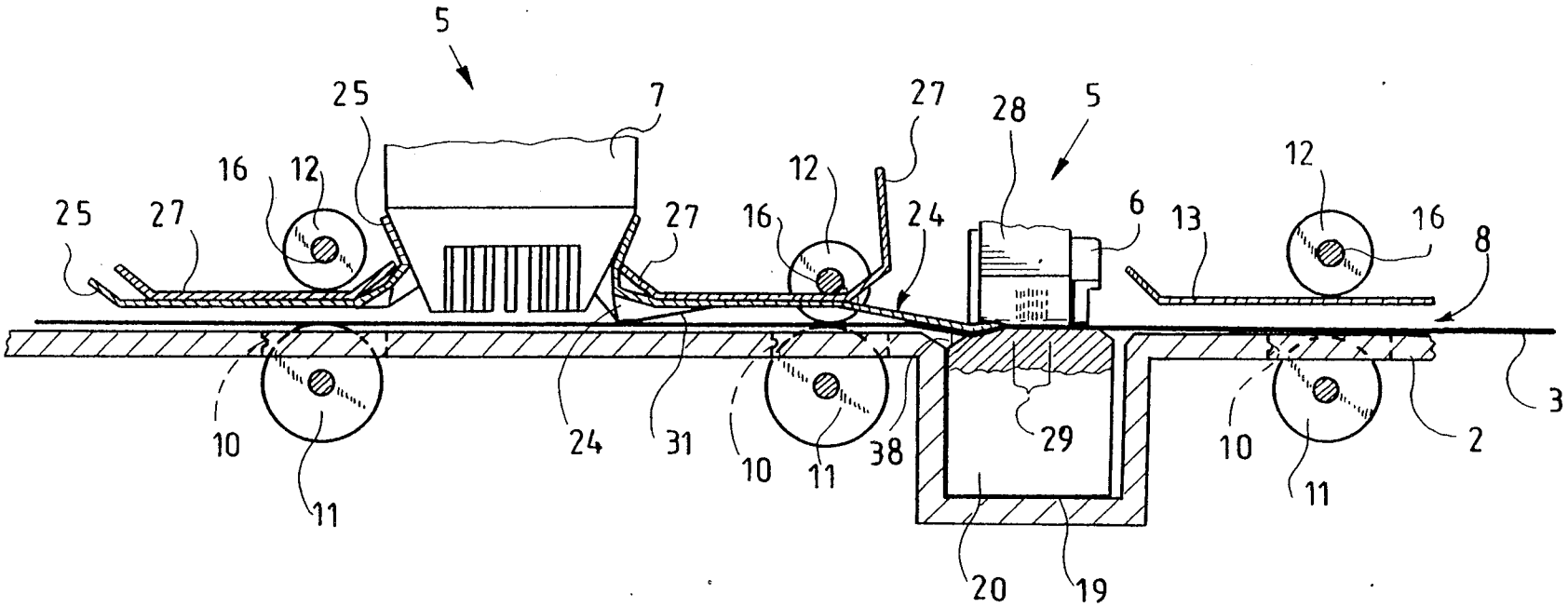
FIG. 3 is a cross-sectional view along section line 2—2 of the embodiment of FIG. 1, with a print head or, respectively, read head in operating position.
Figure 7:
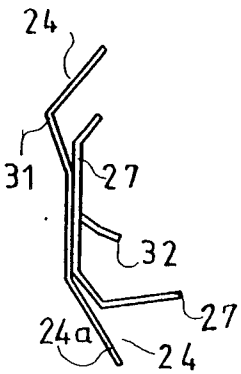
FIG. 7 is a side view of the embodiment of FIG. 6.

The covering 24 is furnished, as illustrated in FIGS. 2, 3, and 7, with an additional angle section 31 directed downwardly into the pull-in shaft or feed throat 8.

Neighboring coverings for neighboring processing means 5, such as for example the print means 6 and the read means 7, can be combined, into a single covering.

Figure 5:
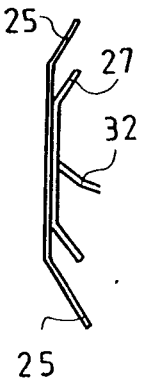
FIG. 5 is a side view of the, embodiment of FIG. 4.
Figure 4:
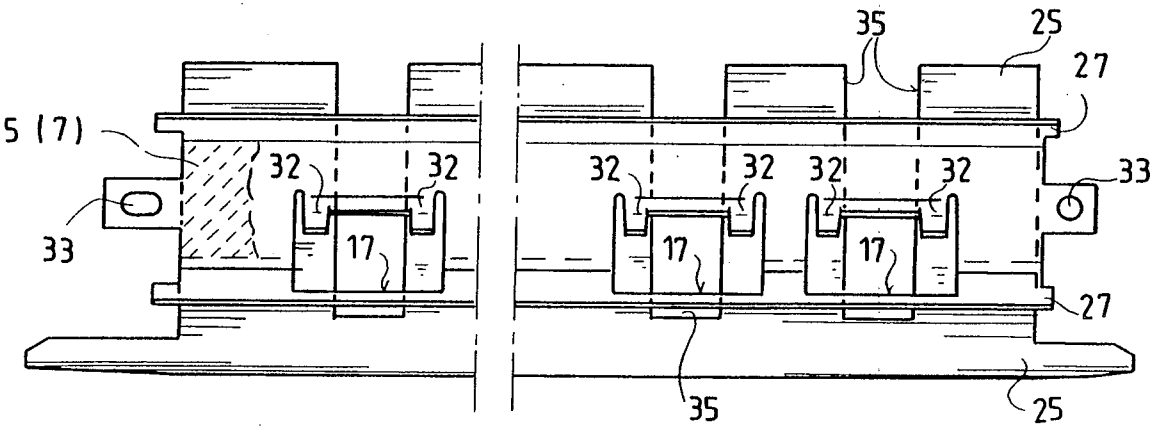
FIG. 4 is a top plan view of a covering together with the guide sheet metal piece in the region of the read means.
Figure 6:
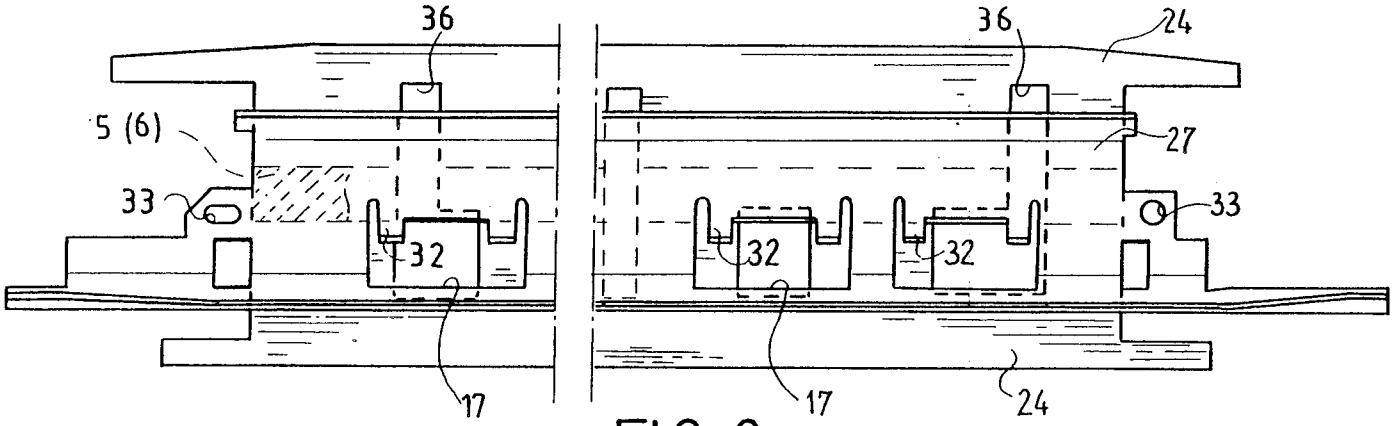
FIG. 6 is a top plan view of a covering together with a different guide sheet metal piece in the region of two neighboring processing means, such as read means and print means.

The cut shape itself of the coverings 24 and 25 is illustrated separately in FIGS. 4 to 7. The guide sheet metal piece 27 is furnished with the openings 17 and with guide angles 32 for the counter rollers 12. The guide sheet metal piece 27 is attached through screw holes 33 with screws 34 at the necessary height-level distance relative to the lower part 2 of the apparatus, as illustrated in FIG. 1. The foil-like coverings 24 and 25, made of transparent plastic, are adapted in their contour edges to the local requirements. Thus, the covering 25 is furnished with cut-out openings 35 in the region of the counter rollers 12 for the read means 7, as illustrated in FIGS. 4 and 5. Similar cut-out openings 36 are furnished in the covering 24, as illustrated in FIGS. 6 and 7.

The coverings 24 and 25 are, in each case, displaceable into two positions relative to the read means 7. In the end position 30 of the read means 7, as illustrated in FIG. 2, the coverings 24 and 25 are closed with the exception of a narrow slot 37. The read means 7 temporarily opens the coverings 24 and 25 in operating position, as illustrated in FIG. 1, during the motions in the cross directions 18. In this case, an insert funnel **26*a* is always maintained. The covering 24 or, respectively, the angle-shaped covering 24*a*, in contrast, is in an upper position, as illustrated in FIG. 2, in the end position 30 of the print means 6, and the covering 24 or, respectively, the angle-shaped covering 24*a* are pressed down, as illustrated in FIG. 3, during the motions in the cross directions 18. Thereby an inclined slope section 38 furnishes a favorable contacting of the angle-shaped covering 24*a* at the print substrate-surface counter support 20. In addition, the ink ribbon 28 is covered outside the print field 29, whereby a smearing is avoided on the substrate 3**.

The diameter of the transport rollers 11 can be from about 1.2 to 1.7 times, and preferably from about 1.3 to 1.5 times the diameter of the counter rollers 12. The angle in rest position of the covering 24 in the area of, for example, the read device, can be for example from about 20 to 70 degrees and is preferably from about 40 to 50 degrees relative to the transport direction 4. Preferably, in rest position, the lowest point of the covering 24 nearly contacts the lower bottom part 2. Guide sheet metal means 27 are provided for limiting the motion of the covering 24 during the motion process of the sliding read head.

The transport rollers 11 can have a diameter which is from about 2 to 5 times, and preferably from about 2.5 to 4 times the distance of the covering 24 to the lower bottom part 2. The rear section of the print support surface 120, as seen in the paper transport direction, can have an angle of from about 5 to 20 degrees and preferably from 8 to 15 degrees relative to the transport direction 4 of the substrate 3. As seen in transport direction, the adjoining corner 119 is preferably either flush with the end section of the print support surface or disposed slightly lower relative to the print support surface and is furnished with an angle for providing a funnel 26, **26*a* for the incoming paper. The angle of the adjoining section 122 can be from about 20 to 45 degrees relative to the transport direction 4 of the paper. The position of the end point of the covering 24 in the area of the read head 7 in rest position is preferably within the levels assumed by the counter roller 12 in horizontal direction. The roller pairs of transport roller 11 and counter roller 12 are preferably disposed at a distance from the device for printing which distance is not larger than the diameter of the roller 12. The covering 24 can comprise an end point, as seen in transport direction 4, at which there is disposed an edge running parallel to form a slot 137. Preferably, the elasticity of the covering 24 is furnished such that the covering 24, based on its thickness, exhibits a lower elasticity in the end section toward the moving device 30 for interaction with the substrate 3 and a higher bending elasticity for a substantially pivoting motion around the connection point between the guide funnel part and the substrate motion defining path section of the covering 24 or 25. Furthermore, the covering 24, 25 is to be provided at, the point of connection between the funnel section and the substrate path defining section with sufficient structural strength to allow the covering 24, 25 to exhibit the said angle in this rest position. The end section of the guide sheet metal piece 27 forming an angle has a width which is from about 0.4 to 0.6 times the width of the end section of the covering 24 or 25. The end section of the covering 24 toward the print head is substantially stiffer as compared to the adjoining section, with the part of the covering 24 defining the paper path such that the end section is substantially uniformly and without substantial distortion moved downward by the print head, when the print head is in operation position relative to the substrate 3. Preferably, the slot 37 between the covering end 24 in the area of the read head in rest position, is from about 0.1 to 0.5 and preferably from 0.2 to 0.4 times the diameter of the counter roller 12. The print substrate support surface, as seen in transport direction 4, is preferably provided with a bevel at its front face for guiding the substrate 3 toward the area of the print head. The covering 24, 25** is preferably made of a plastic material which exhibits high breaking strength.

It will be understood that each of the elements described above, or two or more together, may also find a, useful application in other types of transport devices for substrates differing from the types described above.

While the invention has been illustrated and described as embodied in the context of a device for the transport of substrates in office machines, in particular for records in record-processing apparatus, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for transporting flat substrates in office machines comprising a flat substrate track forming a path for substrate movement;

a lower bottom part of the office machine having openings and furnishing a lower part of a feed throat, wherein a flat substrate can be inserted into the feed throat to run along the flat substrate track;

lower transport means disposed in the openings of the lower bottom part and forming a lower part of the feed throat;

an upper part of the office machine furnishing an upper part of the flat substrate track and an upper part of the feed throat; upper guide means forming an upper part of the feed throat and defining a first opening;

a first elastic covering disposed in a first rest position over the first opening, for covering the first opening at least in part, wherein the elastic covering forms, in its first rest position in transport direction, an insert funnel for the flat substrate;

a first processing means positioned outside of the flat substrate track in contact with the first elastic covering and movable into the area of the flat substrate track thereby temporarily moving the elastic covering into a second operational position, wherein the first opening is elongated in a direction transverse to the transport direction for allowing the processing means to move crosswise to the transport direction for engagement with the flat substrate.

2. The device for transporting flat substrate according to claim 1 wherein the first processing means is a printing means.

3. The device for transporting flat substrates according to claim 1 wherein the first processing means is a reading means.

4. The device for transporting flat substrates according to claim 1 wherein the flat substrate is a recorded to be subjected to recording-processing.

5. The device for transporting flat substrates according to claim 1 wherein the processing means is a printing means, wherein a guide sheet metal piece furnishes the upper guide means, wherein the elastic covering is attached to the guide sheet metal piece, and runs at an angle outside of the guide sheet metal piece, said covering being coordinated with the printing means and covering covers an ink ribbon outside of a print field.

6. The device for transporting flat substrates according to claim 1 wherein the processing means is a reading means, and further comprising a second elastic covering disposed angled relative to a position of the first elastic covering and disposed opposite to the first covering as seen from a middle line of the opening, wherein the first covering and the second covering are provided above the opening, and are disposed relative to each other forming a narrow slot when the reading means is disposed in an end position.

7. The device for transporting flat substrates according to claim 1 wherein the covering is furnished with an additional angle section directed downwardly into the feed throat.

8. The device for transporting flat substrates according to claim 1 further comprising a second opening neighboring the first opening; a second processing means disposed neighboring the first processing means;

a second elastic covering covering the second opening, wherein the first elastic covering associated with the first processing means the second covering associated with the second processing means being integrated into a single covering.

9. A device for the transport of flat substrates, in a transport direction in office machines, in particular for records in recording-processing apparatus, comprising a flat substrate track and processing means, such as printing and/or reading means, positioned outside of the flat substrate track, and a feed throat including transport means which form, in the transport direction, at least two successively disposed, cross-running openings for the processing means, means mounting the processing means for movement crosswise to the transport direction, first and second elastic coverings disposed over each of said openings for covering said openings at least in part, said elastics coverings forming in the transport direction (4), at each of the openings insert funnels (26) for the flat substrates, and means mounting said processing means for movement toward the flat substrate track, said openings being elongated in a direction transverse to the transport direction for allowing the processing means to move transverse to the transport direction for engagement with the flat substrate at selected locations across its width, said first and second elastic coverings being spaced apart such that they are contacted and moved further apart by said processing means as said processing means moves crosswise to the transport direction.

10. The device according to claim 9, further comprising a guide sheet metal piece, wherein said first elastic covering (24) is attached to the guide sheet metal piece (27) as a guide means and where said first elastic covering (24) runs at an angle (24*a*) outside of the guide sheet metal piece (27), where said first elastic covering (24) being coordinated with the printing means (6) and covering an ink ribbon (28) outside of a print field (29).

11. The device according to claim 9, wherein said first and second coverings (24, 25), angled and disposed opposite to each other, are provided above one of said openings (37) for the read means (7), said coverings (24, 25) are disposed opposite to each other, forming a narrow slot up to prior to touching each other while the read means (7) is disposed in an end position (30).

12. The device according to claim 9, wherein said first elastic covering (24) being furnished with an additional angle section (31), directed downwardly into the feed throat (8).

13. The device according to claim 9, wherein neighboring coverings for neighboring processing means (5) are integrated into a single covering.

14. A method for transporting flat substrates in office machines comprising positioning a first processing means outside of a flat substrate track;

inserting a flat substrate into a or feed throat forming an entrance port of the flat substrate track of an office machine including a lower bottom part of the office machine, lower transport means disposed in openings of the lower bottom part, an upper part of the office machine, upper guide means defining a processing opening;

providing an elastic covering for covering said processing opening at least in part while said elastic covering is in a first rest position to form an insert funnel for the flat substrate;

transporting the flat substrate along said flat substrate track;

moving the processing means, originally positioned outside of the flat substrate track, into the area of the flât substrate track, wherein the processing opening is elongated in a direction transverse to a transport direction for allowing the processing means to move crosswise to the transport direction of the flat substrate for engagement with the flat substrate;

and positioning the elastic covering temporarily into a second operational position responsive to movement of said first processing means crosswise to the transport direction.

15. A method for transporting flat substrates according to claim 14 further comprising advancing the flat substrate while the processing means is in an end position.

16. A method for transporting flat substrates according to claim 14 wherein the processing means is a printing means.

17. A method for transporting flat substrates according to claim 14 wherein the processing means is a reading means.

18. A method for transporting flat substrates according to claim 14 wherein the flat substrate is a record to be subjected to record-processing.

19. A method for transporting flat substrates according to claim 14 further comprising a guide sheet metal piece, the processing means is a printing means, and the guide sheet metal piece furnishes the upper guide means, wherein the elastic covering is attached to the guide sheet metal piece, and runs at an angle outside of the guide sheet metal piece, said elastic covering being coordinated with the printing means and covering an ink ribbon outside of a print field.

20. A method for transporting flat substrates according to claim 14 engaging a second covering disposed angled relative to a position of the first covering and disposed opposite to the first covering as seen from a middle line of the opening, wherein the first covering and the second covering are provided above the opening, and disposed relative to each other firming a narrow when second processing a means is disposed in an end position.

21. A method for transporting flat substrates according to claim 14 moving said second processing means, disposed initially outside of the flat substrate track, toward the area of the flat substrate track;

engaging said second elastic covering with the second processing means.

* * * * *